US009444185B2

(12) United States Patent
Noguchi et al.

(10) Patent No.: US 9,444,185 B2
(45) Date of Patent: Sep. 13, 2016

(54) GUIDE DEVICE

(71) Applicant: TOYOTA JIDOSHA KABUSHIKI KAISHA, Toyota-shi, Aichi-ken (JP)

(72) Inventors: Masao Noguchi, Toyota (JP); Kazuhiko Ueda, Seto (JP); Natsuki Nozawa, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/547,754

(22) Filed: Nov. 19, 2014

(65) Prior Publication Data

US 2015/0147903 A1 May 28, 2015

(30) Foreign Application Priority Data

Nov. 26, 2013 (JP) ..... 2013-244182

(51) Int. Cl.
*H01R 13/631* (2006.01)
*H01R 12/70* (2011.01)

(52) U.S. Cl.
CPC ..... *H01R 13/631* (2013.01); *H01R 12/7005* (2013.01); *H01R 12/7076* (2013.01)

(58) Field of Classification Search
CPC ..... H01R 13/6315
USPC ..... 439/377, 378, 247, 248, 374
See application file for complete search history.

(56) References Cited

U.S. PATENT DOCUMENTS

| | | | | |
|---|---|---|---|---|
| 6,537,089 | B1 * | 3/2003 | Montague | H01R 13/4534 439/137 |
| 6,857,884 | B2 * | 2/2005 | Kim | H04M 1/0202 439/137 |
| 7,008,242 | B2 * | 3/2006 | Inoue | H01R 4/643 439/268 |
| 2003/0077929 | A1 * | 4/2003 | Funatsu | H01R 13/4532 439/137 |
| 2003/0117788 | A1 | 6/2003 | Kim et al. | |
| 2007/0049079 | A1 * | 3/2007 | Nalwad | H01R 13/4532 439/137 |
| 2013/0084751 | A1 * | 4/2013 | Shindo | H01R 13/6315 439/626 |

FOREIGN PATENT DOCUMENTS

| | | |
|---|---|---|
| CN | 1428990 A | 7/2003 |
| JP | 53-150488 | 4/1977 |
| JP | 2003-323941 A | 11/2003 |
| JP | 2013-089509 A | 5/2013 |

OTHER PUBLICATIONS

Partial Translation of the Office Action issued Oct. 6, 2015 from the Japanese Patent Office in counterpart application No. 2013-244182.

* cited by examiner

*Primary Examiner* — Tulsidas C Patel
*Assistant Examiner* — Marcus Harcum
(74) *Attorney, Agent, or Firm* — Sughrue Mion, PLLC

(57) ABSTRACT

A guide device that guides a component terminal includes: a guide portion configured to guide the component terminal to a specified position; and a separating mechanism portion configured to move the guide portion away from the component terminal after the guidance of the component terminal, as compared with before the guidance of the above component terminal.

5 Claims, 12 Drawing Sheets

GUIDE DEVICE

INCORPORATION BY REFERENCE

The disclosure of Japanese Patent Application No. 2013-244182 filed on Nov. 26, 2013 including the specification, drawings and abstract is incorporated herein by reference in its entirety.

BACKGROUND OF THE INVENTION

1. Field of the Invention

The present invention relates to a guide device, and more particularly, to a device which has a guide function of guiding a component terminal to be inserted into an electronic circuit substrate or the like towards a specified position.

2. Description of Related Art

As a method for easily inserting a terminal of an electric component, a connector or the like (referred to as component terminal hereinafter) into a contact portion of a connector, a through hole or the like provided on an electronic circuit substrate, there is a method in which a guide component, which has a guide function of guiding the component terminal to the contact portion, is mounted on a side of the electronic circuit substrate from which the component terminal is inserted.

For example, a guide component having a form of a guide hole with an opening portion spreading in a tapered shape is proposed in Japanese Patent Application Publication No. 2013-089509 (JP 2013-089509 A). In JP 2013-089509 A, the insertion of the component terminal towards the contact portion is made easy by mounting the guide component in the above form to a position corresponding to the contact portion on the electronic circuit substrate.

In addition, while not providing a guide component for directly guiding the component terminal, Japanese Patent Application Publication No. 2003-323941 (JP 2003-323941 A) discloses a technique in which for assisting in engaging a first connector having the component terminal with a second connector at an object side, the second connector is received in a holder.

However, in a prior guide component 110 described in the above JP 2013-089509 A, a state in which a component terminal 23 is in contact with or close to a guide component 110 (specifically, a guide hole) is maintained (see an area indicated by the ellipse F in FIG. 11) even after the component terminal 23 is guided to a specified through hole 21 in a substrate 20 such as an electronic circuit substrate and the mounting of the component terminal 23 to the substrate 20 is completed.

Conventionally, there is an intrinsic value of resonance in a component, and where there are a plurality of components, individual intrinsic values of resonance of these components are generally different from each other. Thus, for example, in a vehicle or the like which carries a plurality of various components thereon, the plurality of components vibrate separately at respective phases and amplitudes in a vibration environment, thus resulting in a relative vibration between the component terminal and the guide component. Therefore, if, as in the above JP 2013-089509 A, a relative vibration is generated between the component terminal 23 and the guide component 110 in the state where the component terminal 23 contacts with the guide component 110, a problem that the component terminal 23 is worn by the contact face (the area of ellipse F in FIG. 11) will arise.

SUMMARY OF THE INVENTION

The present invention provides a guide device, which has a mechanism that enables a component terminal to change into a state of not contacting with or not being close to a guide component after the component terminal is guided to a specified position on a substrate.

A guide device according to an aspect of the present invention has a guide portion configured to guide a component terminal to a specified position, and a separating mechanism portion configured to move the guide portion away from the component terminal after the guidance of the component terminal as compared with before the guidance of the component terminal. According to this structure, after the component terminal is guided to the specified position, a contact of the component terminal with the guide portion due to vibration or the like can be avoided.

In the above aspect, the guide portion may define a run-through hole having a slope from one end to the other end formed by making at least two guide components abut with each other, and the separating mechanism portion may be configured to move the guide portion away from the component terminal by making the at least two guide components separate from each other after the guidance of the component terminal. More specifically, the above run-through hole may include an opening portion formed in a conical shape or a square-tapered shape, and a guide hole may extending from a vertex of the opening portion and having a shape corresponding to that of the component terminal. According to this structure, the guide portion can easily move away from the component terminal.

In the above aspect, the separating mechanism portion may be configured to move the guide portion away from the component terminal according to an operation applied externally after the guidance of the component terminal. In this way, the guide portion is enabled to be away from the component terminal manually after it is ensured that the component terminal has been guided to a specified position.

In the above aspect, the guide device may be mounted to one surface of a substrate in such a manner that a through hole formed in the substrate corresponds to the guide portion, the component terminal inserted into the guide portion from the one surface side of the substrate passes through the through hole and is guided to a position of penetrating through the other surface of the substrate, and the separation mechanism portion may be configured to move the guide portion away from the component terminal by making a connector terminal engage with the component terminal that passes through the other surface of the substrate. In this way, after the component terminal is guided to the specified position, the guide portion can automatically move away from the component terminal simultaneously with the engagement of the component terminal with the connector terminal.

In the above aspect, the guide portion may be configured in such a shape that when the guide device is mounted to the one surface of the substrate in such a manner that a through hole formed in the substrate corresponds to the guide portion, before the component terminal is guided to the specified position, the guide portion may define the run-through hole in the through hole so as to extend substantially to the other surface of the substrate. According to this configuration, the positional accuracy of inserting the component terminal into the guide hole can be improved.

In the above aspect, the guide device may be configured in such a manner that after the guidance of the component terminal, the separating mechanical portion moves the guide portion away from the component terminal so that a space for achieving insulation which corresponds to the through hole is provided between the component terminal and the substrate. According to this configuration, an insulation distance between the component terminals can be ensured by the space created between the component terminal and the substrate.

According to the above described guide device, after the component terminal is guided to the specified position (inserted into the through hole of the substrate or the like), a state in which the guide hole of the guide device is not in contact with or close to the component terminal can be formed. Therefore, in the guide device according to the present invention, the component terminal can be prevented from being worn due to a contact with the guide portion even if the component terminal and the guide portion vibrate respectively at different phases and amplitudes to generate a relative vibration in a vibration environment.

In addition, according to the above described guide device of the invention, since the guide hole of the guide portion is formed to have a length extending substantially to the surface of the substrate, the positional accuracy of inserting the component terminal into the guide hole is improved. Further, in the above described guide device of the invention, the guide portion is made away from the component terminal for forming the state in which the guide hole is not in contact with or close to the component terminal, thus the insulation distance between the component terminals can be sufficiently ensured after the component terminals are guided to the specified positions.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

1. Configuration of Guide Device

Firstly, an overall configuration of a guide device 10 according to an embodiment of the present invention is described with reference to FIGS. 1 to 4.

Figure 1A:
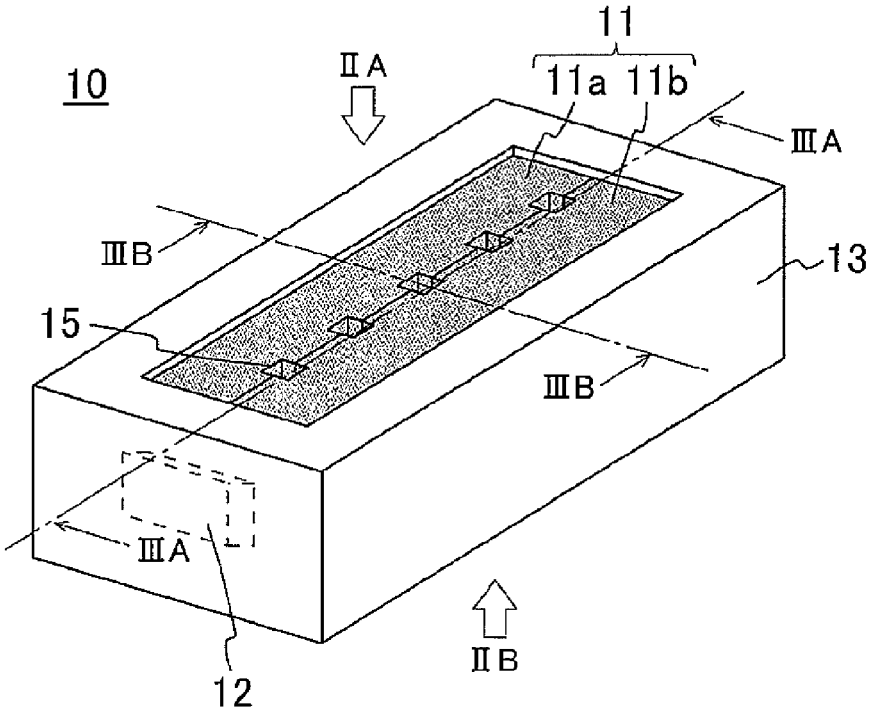
FIGS. 1A and 1B are perspective views briefly illustrating a configuration of a guide device according to an embodiment of the present invention.
Figure 1B:
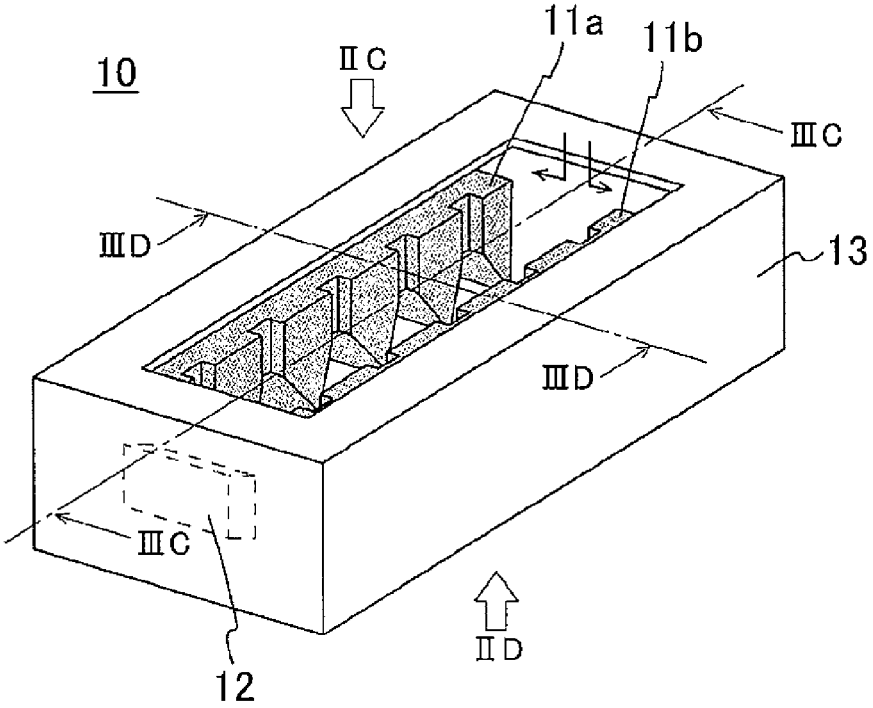
Figure 2A:
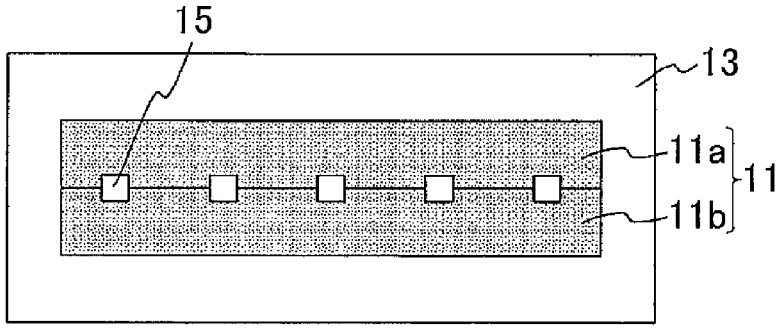
FIGS. 2A to 2D are views seen in directions IIA, IIB, IIC and IID in the guide device shown in FIGS. 1A and 1B respectively.
Figure 2B:
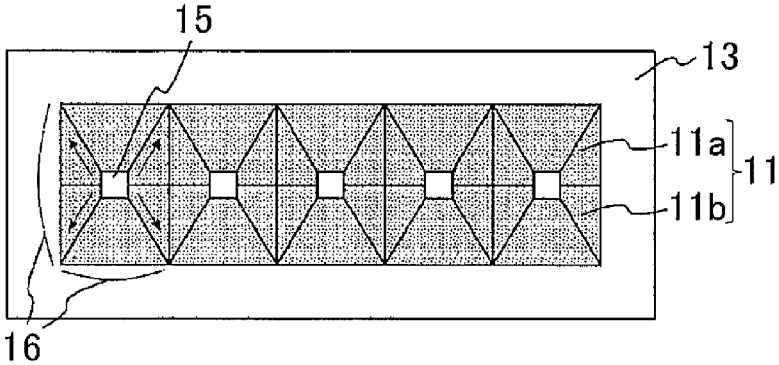
Figure 2C:
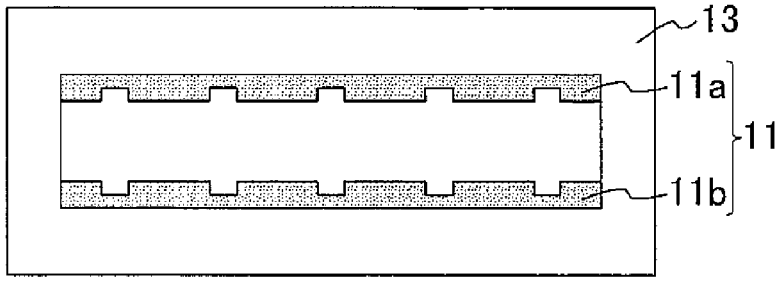
Figure 2D:
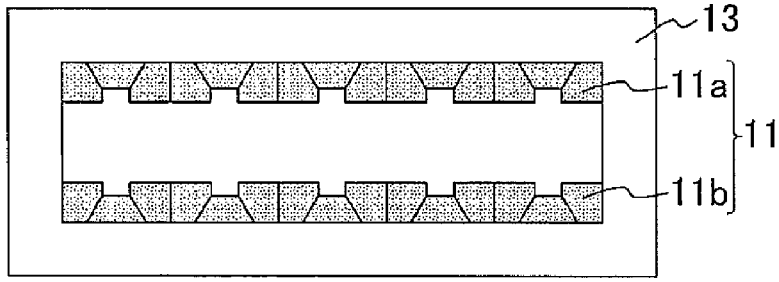
Figure 3A:
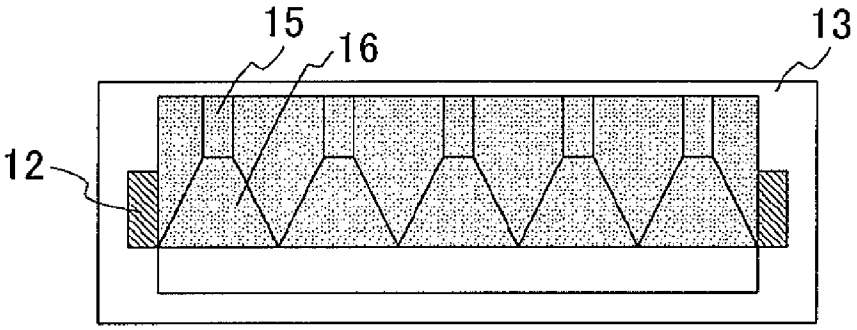
FIGS. 3A to 3D are sectional views taken in directions IIIA, IIIB, IIIC, and IIID in the guide device shown in FIGS. 1A and 1B respectively.
Figure 3B:
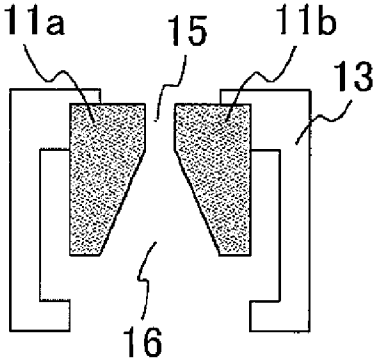
Figure 3C:
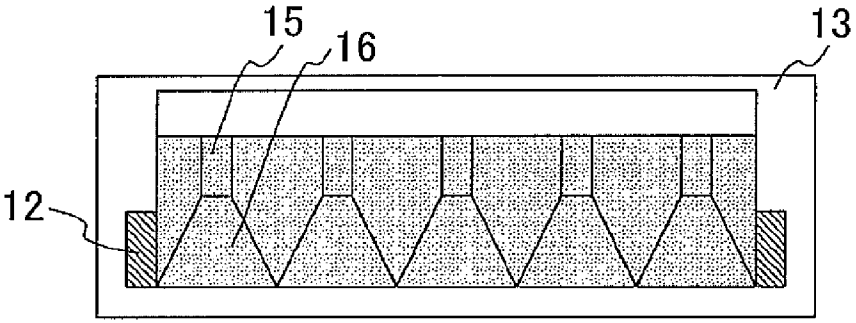
Figure 3D:
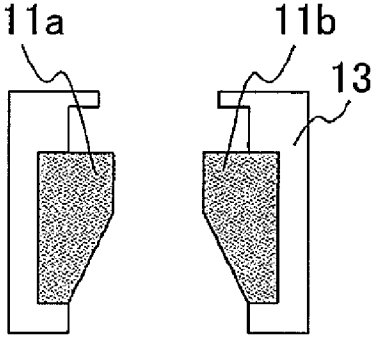
Figure 4A:
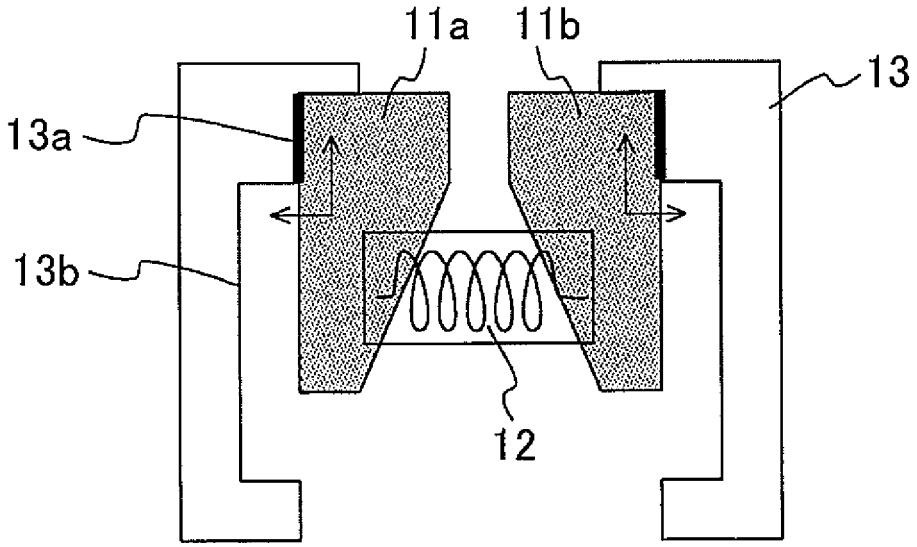
FIGS. 4A and 4B are views illustrating a relationship between a guide component and a separating mechanism portion in states shown in FIGS. 3B and 3D.
Figure 4B:
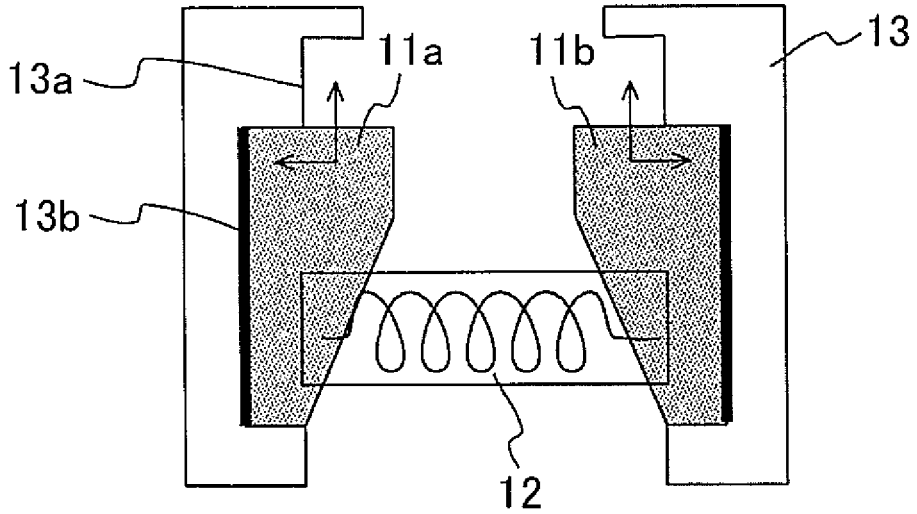

FIG. 1A is a brief perspective view briefly showing a configuration in which a guide portion 11 of the guide device 10 according to the embodiment of the present invention is formed into a closed state. FIG. 1B is a brief perspective view briefly showing a configuration in which the guide portion 11 of the guide device 10 according to the embodiment of the present invention is formed into an open state. FIGS. 2A and 2B are views of the guide device 10 shown in FIG. 1A seen in directions IIA (top view) and IIB (bottom view) respectively. FIGS. 2C and 2D are views of the guide device 10 shown in FIG. 1B seen in directions IIC (top view) and IID (bottom view) respectively. FIGS. 3A and 3B are sectional views of the guide device 10 shown in FIG. 1A taken along IIIA-IIIA (front sectional view) and IIIB-IIIB (side sectional view) respectively. FIGS. 3C and 3D are sectional views of the guide device 10 shown in FIG. 1B taken along IIIC-IIIC (front sectional view) and IIID-IIID (side sectional view) respectively. FIG. 4A is a view illustrating a relationship of guide components 11*a* and 11*b* with a separating mechanism portion 12 when in the closed state as shown in FIG. 3B. FIG. 4B is a view illustrating a relationship of the guide components 11*a* and 11*b* with the separating mechanism portion 12 when in the open state as shown in FIG. 3D.

The guide device 10 according to the embodiment of the present invention shown in FIG. 1 has a guide portion 11, a separating mechanism portion 12 and an outer portion 13. The guide portion 11 is formed by two movable guide components 11*a* and 11*b*. The separating mechanism portion 12 is a structure having a mechanism enabling the guide components 11*a* and 11*b* to change into a closed state in which they abut with each other or an open state in which they are separated from each other. The guide portion 11 formed by the above guide components 11*a* and 11*b* and the separating mechanism portion 12 are covered by the outer portion 13 which also serves as a receiving case, thereby being packaged as a single device.

The guide portion 11 becomes a form of having guide holes and opening portions in the closed state of the guide components 11*a* and 11*b* in which they abut with each other. Specifically, as exemplarily shown in FIGS. 1A, 2A and 3B, in the closed state of the guide components 11*a* and 11*b* in which they abut with each other, rectangular guide holes 15 are formed at equal intervals. The guide holes 15 are arranged to have intervals and shapes corresponding to those of component terminals as insert objects which will be described later. Furthermore, the guide holes 15 exemplarily shown in various drawings are merely an example, and the number (other than 5), intervals (unequal intervals) and shapes (round, ellipse) or the like of the guide holes 15 may be designed freely according to the form of the component terminals as the insert objects. In addition, as exemplarily shown in FIGS. 2B, 3A and 3B, in the closed state of the guide components 11*a* and 11*b* in which they abut with each other, an opening portion 16 is formed at each of the guide holes 15. The opening portion 16 in this embodiment is formed to be of a substantially square-tapered shape which expands in directions indicated by arrows in FIG. 2B at a constant slope from the guide hole 15. Furthermore, the opening portions 16 exemplarily shown in various drawings are merely an example, and they may be designed freely. For example, the opening portion 16 may have a varied slope, or may be formed in a conical shape, etc. In this way, in the closed state of the guide components 11*a* and 11*b* in which they abut with each other, the guide component 11 is formed with a run-through hole provided with a slope from one end to the other end by the guide holes 15 and the opening portions 16, i.e., a so-called funnel configuration.

The separating mechanism portion 12 is a structure which enables the form of the guide portion 11 to be varied by bringing the guide components 11*a* and 11*b* into the closed state in which they abut with each other or the open state in which they are separated from each other. As an example of the separating mechanism portion 12, an elastic body (spring, gum, etc.) inserted between the guide component 11*a* and the guide component 11*b* is considered. As a specific example illustrated in this embodiment, the separating mechanism portion 12 is shown as a mechanism which has a shape mated with that of an inner wall of the outer portion 13 to realize the closed state or the open state in the following manner.

As shown in FIGS. 3B, 3D, 4A and 4B, a first wall surface 13*a* and a second wall surface 13*b* having a smaller wall thickness than the first wall surface 13*a* are formed in a stepped shape at inner wall sides of the outer portion 13 in a direction in which the guide components 11*a* and 11*b* are separated. In the separating mechanism portion 12, a helical spring is used as the elastic body, and the helical spring is inserted between the guide components 11*a* and 11*b*. FIG. 4 is a view briefly illustrating the relationship of the guide components 11*a* and 11*b* with the separating mechanism portion 12.

The closed state of the guide portion 11 is a state in which the separating mechanism portion 12 maintains an elastic force (a state in which the helical spring is compressed) and a portion of a side face of each of the guide components 11*a* and 11*b* respectively abuts against the first wall surfaces 13*a* of the outer portion 13 (FIG. 4A). The form of the guide portion 11 shown in FIGS. 1A, 2A, 2B, 3A and 3B is achieved in this state. The open state of the guide portion 11 is a state in which the separating mechanism portion 12 maintains a weaker elastic force than in the closed state or the elastic force of the separating mechanism portion 12 is zero (a state in which the helical spring is stretched) and a portion of a side face of each of the guide components 11*a* and 11*b* respectively abuts against the second wall surfaces 13*b* of the outer portion 13 (FIG. 4B). The form of the guide portion 11 shown in FIGS. 1B, 2C, 2D, 3C, and 3D is achieved in this state.

The movement from the state in which the portion of the side face of each of the guide components 11*a* and 11*b* respectively abuts against the first wall surfaces 13*a* of the outer portion 13 as shown in FIG. 4A to the state in which the portion of the side face of each of the guide components 11*a* and 11*b* respectively abuts against the second wall surfaces 13*b* of the outer portion 13 as shown in FIG. 4B may be realized through the following actions. For example, from the state shown in FIG. 4A, an upper surface of each of the guide components 11*a* and 11*b* is pressed downwardly until the side faces of the guide components 11*a* and 11*b* do not abut against the first wall surfaces 13*a*, thus moving towards the state shown in FIG. 4B. The pressing on the upper surfaces of the guide components 11*a* and 11*b* may be performed by fingers, or may be performed by a dedicated tool (a thrust pin, etc.). Furthermore, the position at which the pressing is applied on the upper surfaces of the guide components 11*a* and 11*b* is not limited to the position shown in FIG. 1A by hatching. For example, a hole for inserting the dedicated tool or the like may be additionally arranged in an upper surface of the outer portion 13, and the upper surfaces of the guide components 11*a* and 11*b* may be pressed via this hole (see FIG. 6A).

Furthermore, the movement from the state in which the portion of a the face of each of the guide components 11*a* and 11*b* respectively abuts against the second wall surfaces 13*b* of the outer portion 13 as shown in FIG. 4B to the state in which the portion of the side face of each of the guide components 11*a* and 11*b* respectively abuts against the first wall surfaces 13*a* of the outer portion 13 as shown in FIG. 4A may also be realized in the same way. For example, from the state shown in FIG. 4B, the side faces of the guide components 11*a* and 11*b* are pressed in a direction towards the center of the outer portion 13 until the upper surfaces of the guide components 11*a* and 11*b* are no longer stuck by the step difference between the first wall surface 13*a* and the second wall surface 13*b*, thus moving towards the state in FIG. 4A. A dedicated tool (a thrust pin, etc.) may be used to press the side faces of the guide components 11*a* and 11*b*. For example, a hole for inserting the dedicated tool or the like may be additionally arranged in each of two side faces of the outer portion 13, and the side faces of the guide components 11*a* and 11*b* are respectively pressed via the hole.

According to the above configuration, the guide device 10 according to the embodiment of the present invention enables the guide portion 11 to change into the closed state or the open state.

2. Method for Guiding a Component Terminal Based on the Guide Device

Next, a method for guiding a component terminal by the guide device 10 according to the embodiment of the present invention is specifically described with reference to FIGS. 5A to 5D. Furthermore, in the following FIGS. 5A to 5D, an example in which the guide device 10 according to the present invention in mounted on a lower surface (one surface) of a substrate 20 such as an electronic circuit substrate in a state where a component terminal 23 of an electric component or the like is inserted into a through hole 21 formed in the substrate 20 from the lower surface of the substrate 20 is described. The guide device 10 is mounted in advance in a position where the guide holes 15 of the guide portion 11 are in alignment with the through holes 21 of the substrate 20.

Figure 5A:
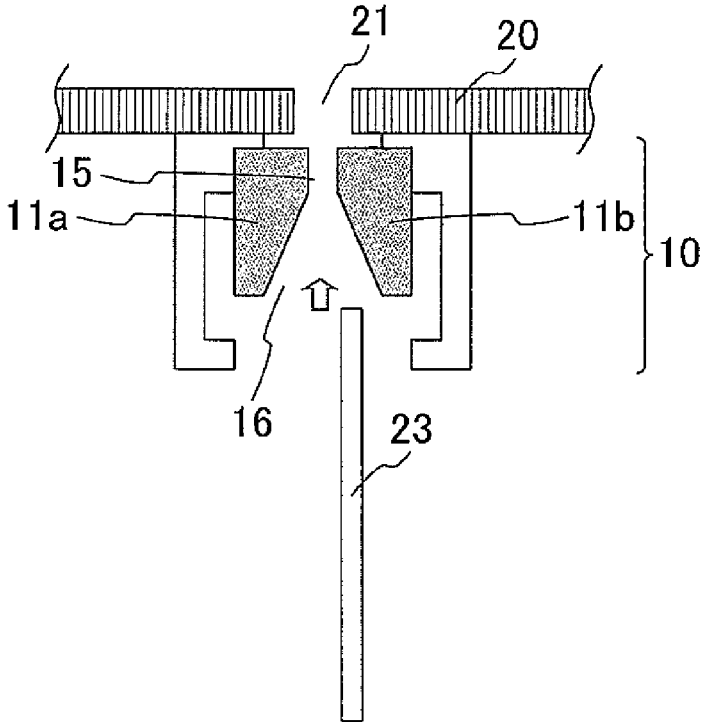
FIGS. 5A to 5D are views illustrating a guide method of guiding a component terminal by the guide device.
Figure 5B:
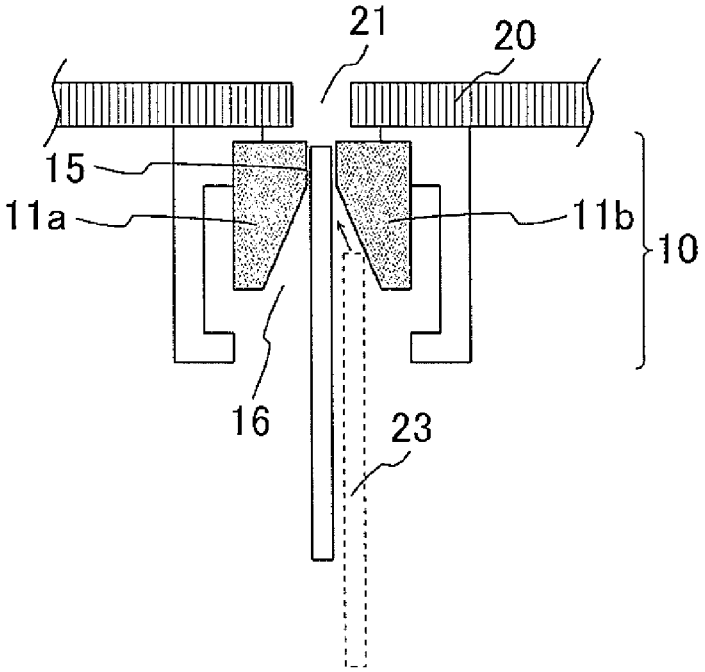
Figure 5C:
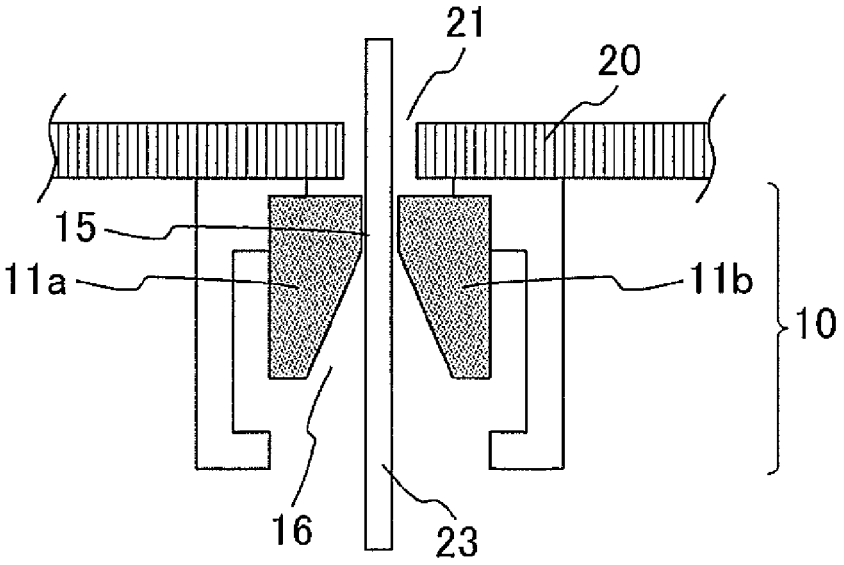
Figure 5D:
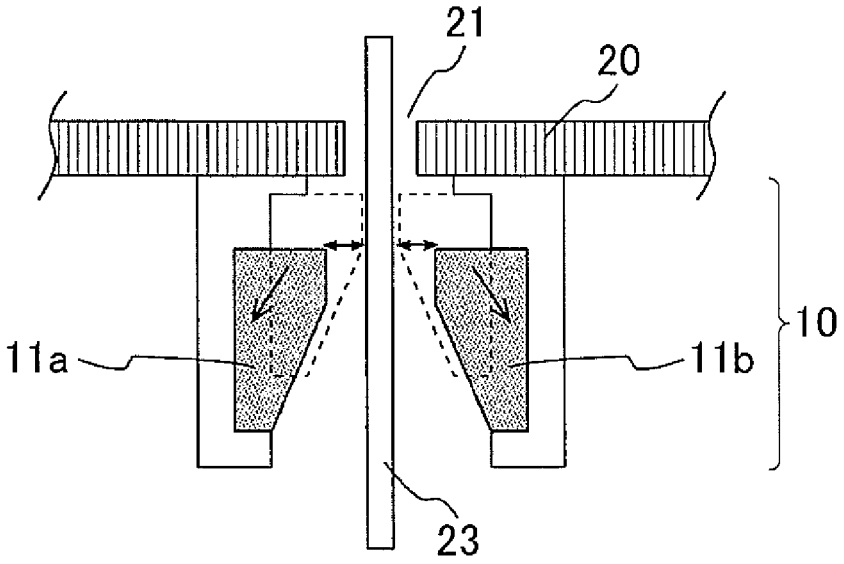

The guide device 10 is mounted to the substrate 20 with the guide portion 11 in the closed state (FIG. 5A). In the mounted state, if the component terminal 23 is inserted into the guide device 10, a front end of the component terminal 23 is directly inserted into the guide hole 15, or is guided via an inclined surface of the opening portion 16 of the guide portion 11 to be inserted into the guide hole 15 (FIG. 5B). The component terminal 23 inserted into the guide hole 15 passes through the through hole 21 of the substrate 20, and is further guided to a specified position that protrudes from an upper surface (the other surface) of the substrate 20 (FIG. 5C). Thus, the engagement between the component terminal 23 and the substrate 20 (and the guide device 10) is achieved. A portion of the component terminal 23 that protrudes from the upper surface of the substrate 20 is engaged with a connector mounted on the upper surface of the substrate 20, or is fixed to the substrate 20 via soldering, for example.

Furthermore, if the engagement between the component terminal 23 and the substrate 20 is completed, the guide device 10 allows the guide portion 11 to be changed from the closed state to the open state (FIG. 5D) manually or automatically. In the open state, the guide components 11*a* and 11*b* move towards a position (separate position) away from the component terminal 23, and the guide hole 15 is no longer formed. Through an variation from the closed state to the open state, the guide portion 11 is made away from (separated from) the component terminal 23, thus avoiding a state in which the guide hole 15 used in guiding the component terminal 23 maintains in contact with or close to the component terminal 23.

Figure 6A:
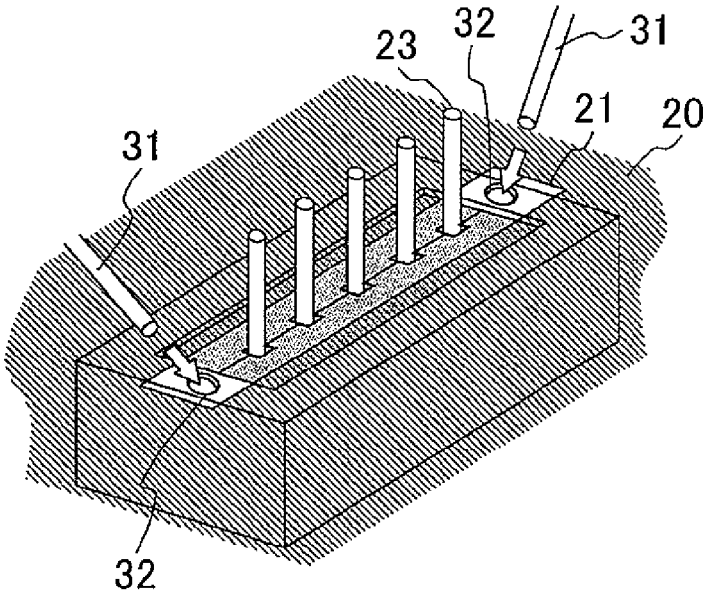
FIGS. 6A and 6B are views illustrating an example of a method for shifting a guide portion to an open stated from a closed state.
Figure 6B:
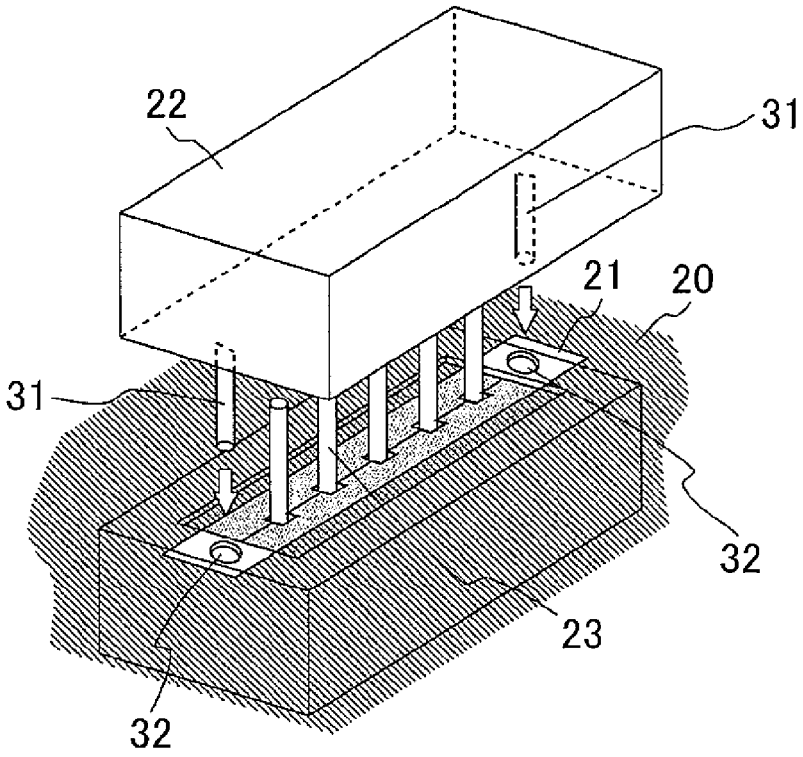

Furthermore, as a method for manually changing the guide portion 11 from the closed state to the open state, for example, an operation of pressing a dedicated tool such as a thrust pin 31 into an insertion hole 32, which is not concealed by the substrate 20, of the guide device 10 or the like is considered for the purpose of releasing the elastic force of the separating mechanism portion 12, etc. (FIG. 6A). In addition, as a method for automatically changing the guide portion 11 from the closed state to the open state, the following is considered, for example: a connector 22 which is provided with a thrust pin 31 is engaged with the component terminal 23 protruding from the upper surface of the substrate 20, while simultaneously the thrust pin 31 performs the action of pressing into the insertion hole 32 of the guide device 10, thereby releasing the elastic force of the separating mechanism portion 12, etc (FIG. 6B). FIGS. 6A and 6B are view of the guide device 10 mounted to a lower surface of the substrate 20 viewed in a way of penetrating through the substrate 20 (oblique hatching).

3. Specific Example of Using the Guide Device

Figure 7:
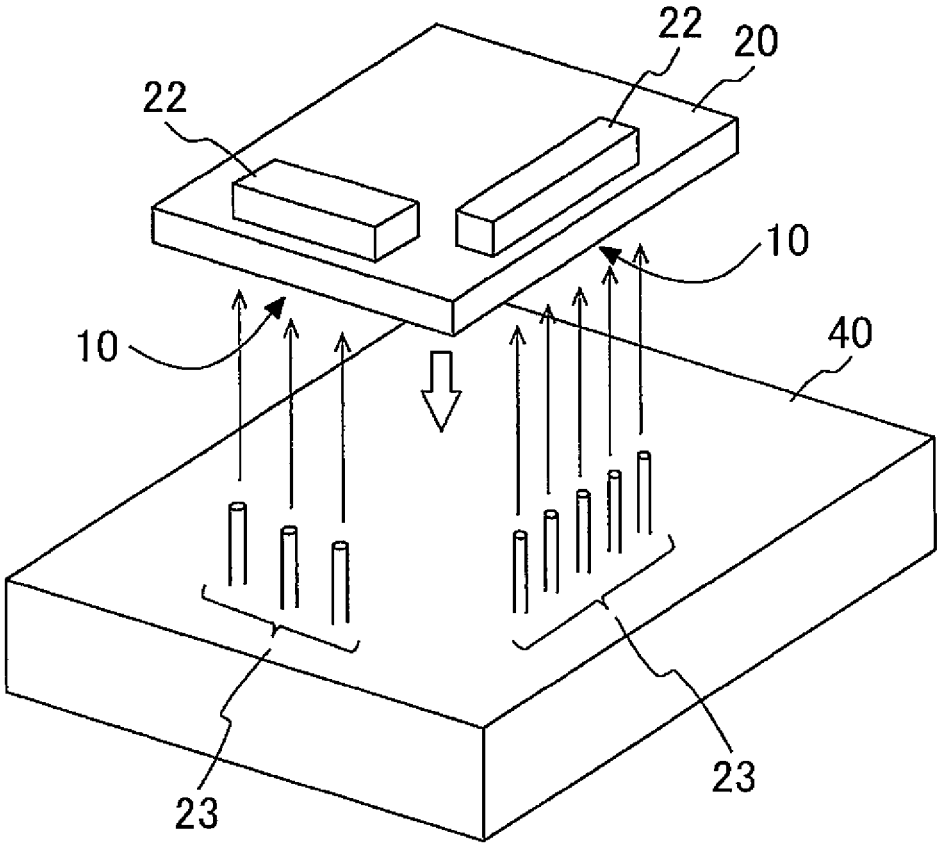
FIG. 7 is a perspective view illustrating a specific example of using the guide device.

Next, as a specific example of using the guide device 10, for example, a configuration in which the substrate 20 is assembled with a unit 40 having a plurality of component terminals 23 as shown in FIG. 7 is described. In the specific example, the substrate 20 is provided with through holes 21 (not shown) at positions corresponding to those of the plurality of component terminals 23 provided in the unit 40. A connector 22 is positioned and fixed by soldering onto an upper surface of the through holes 21 of the substrate 20, and the guide device 10 with the guide portion 11 in the closed state (not shown) is positioned and fixed by soldering onto a lower surface of the through hole 21. The guide function of the guide portion 11 is utilized to make the plurality of component terminals 23 fit with the guide devices 10 and assemble (engage) the substrate 20 with the unit 40 so that the plurality of component terminals 23 are engaged with the connectors 22, thereby achieving an electrical connection. After the component terminal 23 and the substrate 20 are assembled by utilizing the guide device 10, the unit 40 and the substrate 20 are fastened together by a bolt. Then, the component terminal 23 is electrically connected to the substrate 20 by engaging with connector 22, and meanwhile, the guide portion 11 of the guide device 10 is formed into the open state by means of the thrust pin of the connector 22 so as to move the guide device 10 away from (separate from) the component terminal 23, thereby avoiding contact of the component terminal 23 with the guide portion 11 of the guide device 10.

As described above, the guide device 10 according to the embodiment of the present invention has a mechanism enabling the guide portion 11 to be away from (separate from) the component terminal 23 after the component terminal 23 is guided to a specified position (through hole 21 of the substrate 20 or the like). With this mechanism, a state in which the guide hole 15 of the guide device 10 is not in contact with or close to the component terminal 23 can be formed after the component terminal 23 is inserted into the substrate 20 or the like. Therefore, with the guide device 10 according to the present invention, the component terminal 23 can be prevented from being worn due to a contact with the guide portion 11 even if the component terminal 23 and the guide portion 11 vibrate respectively at different phases and amplitudes to generate a relative vibration in a vibration environment.

4. Modified Examples of the Guide Device

Further, an embodiment in which the guide portion 11 of the guide device 10 according to the present invention described above is modified in shape is described with reference to FIGS. 8 to 10.

In the configuration having a mechanism, i.e., the guide portion 11, configured to guide the component terminal 23 towards the through hole 21 in the substrate 20 or the like, as a result of the formation of the opening portion 16 provided with a slope, the length of the guide hole 15 that contacts the component terminal 23 during guiding is reduced. In addition, due to the tolerance that is predictable in design and the loosening generated by a deviation of each component, a clearance is generally generated between the guide hole 15 formed by the guide components 11*a* and 11*b* and the component terminal 23.

Figure 8A:
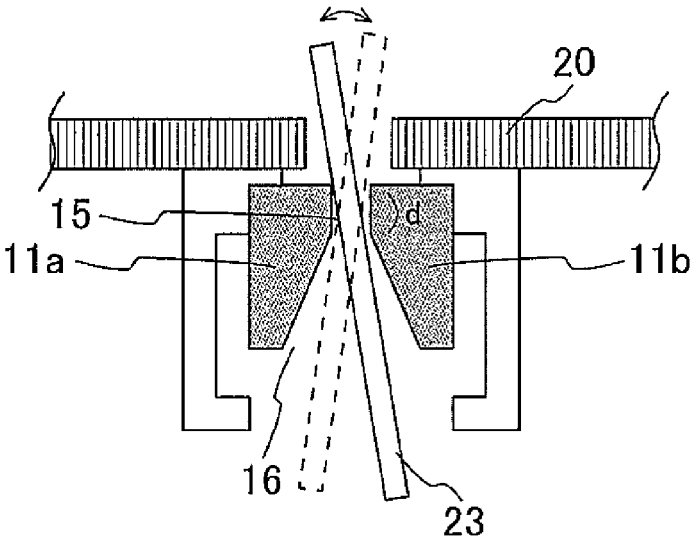
FIGS. 8A and 8B are views illustrating an action of the guide device.
Figure 8B:
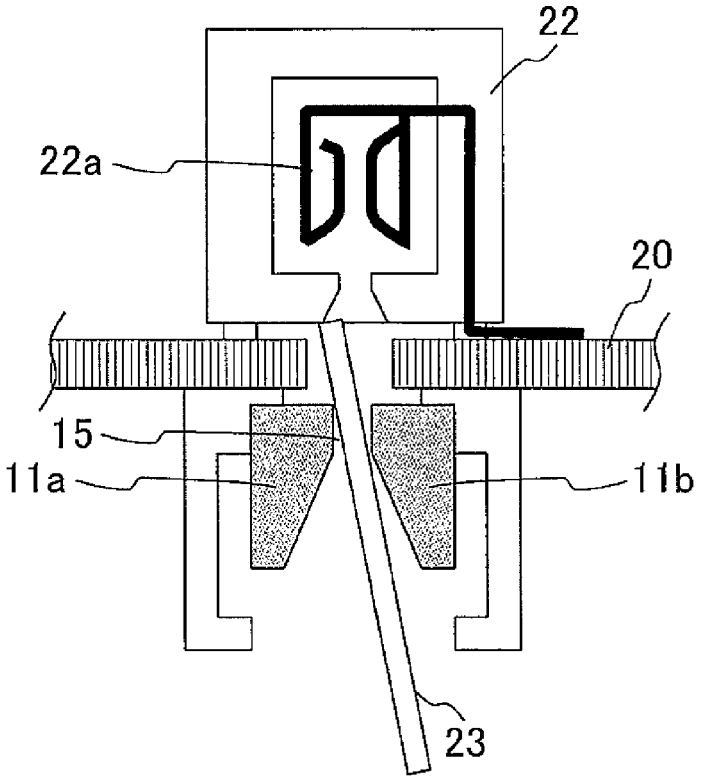

However, the clearance between the guide hole 15 and the component terminal 23 will cause a deterioration of the positional accuracy when the component terminal 23 is inserted into the guide hole 15, as shown in FIG. 8A, and the deterioration of the positional accuracy is significant in a case where the length d of the guide hole 15 that contacts the component terminal 23 is short. For example, as shown in FIG. 8B, there is a concern that the deterioration of the positional accuracy will result in poor engagement of the component terminal 23 with respect to the terminal 22*a* of the connector 22 mounted to the upper surface of the substrate 20.

Therefore, in this modified example, with the mechanism exclusive to the present invention which performs the closing or opening operation by a separation of two guide components, a guide device 50 with guide components 51*a* and 51*b* having the following shape features is provided.

Figure 9A:
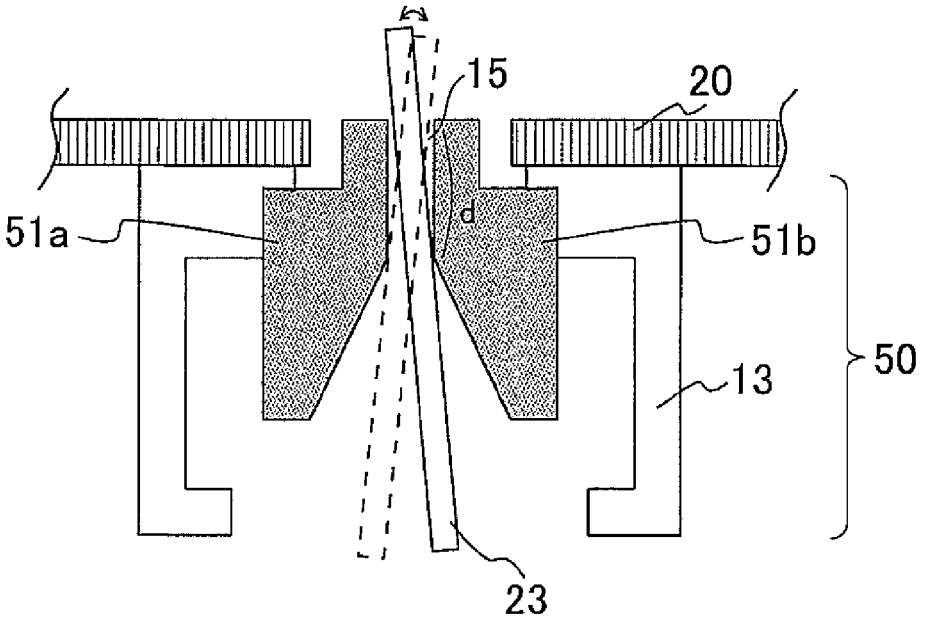
FIGS. 9A and 9B are sectional views briefly illustrating a configuration of a guide device according to a modified example of an embodiment of the present invention.
Figure 9B:
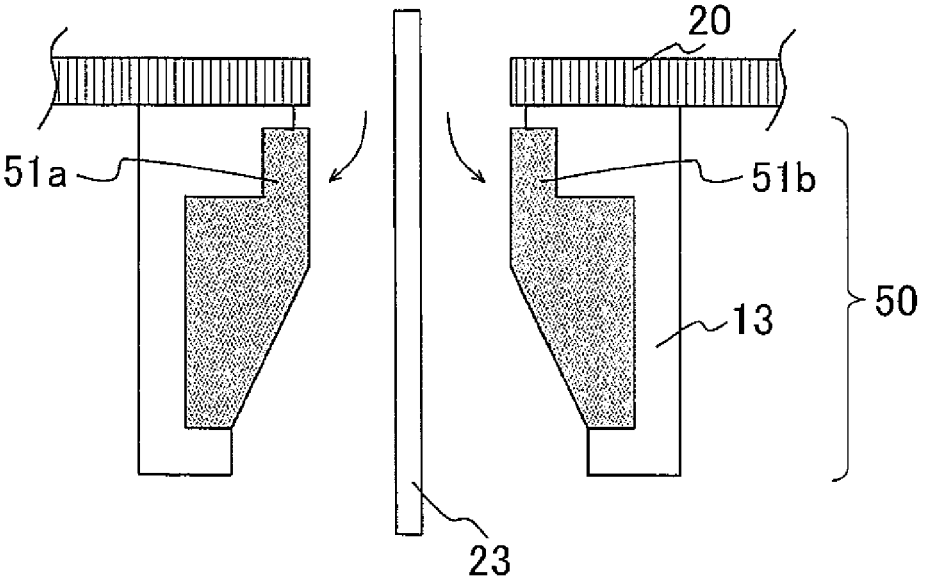

FIG. 9 shows side sectional views of the guide device 50 according to a modified example of the present invention, wherein FIG. 9A, which is similar to FIG. 3B, is a sectional view taken along D1-D1 where the guide portion 11 is formed into the closed state, and FIG. 9B, which is similar to FIG. 3D, is a sectional view taken along IIID-IIID where the guide portion 11 is formed into the open state. The guide device 50 of the modified example of the present invention as shown in FIG. 9 is characterized in the shape of the two movable guide components 51*a* and 51*b* forming the guide portion 11. Furthermore, the other structures of the guide device 50 of this modified example are the same as those of the above guide device 10, and a repeated explanation will thus be omitted.

The guide components 51*a* and 51*b*, when in the closed state, have a shape of extending the length d of the guide hole 15 to an extent that reach the upper surface of the substrate 20 (substantially the other surface) (FIG. 9A). According to such a shape, the guide device 50 of this modified example, as compared with the above guide device 10 provided with the opening portion 16 having the same slope, can improve the positional accuracy in inserting the component terminal 23 into the guide hole 15 (in contrast to FIG. 8A). In addition, the guide components 51*a* and 51*b* change from the closed state to the open state after the engagement between the component terminal 23 and the substrate 20 is completed (FIG. 9B). According to the open state, the guide components 51*a* and 51*b* move to a position that is away from the component terminal 23, and the portion of each of the guide components 51*a* and 51*b* extending up to the upper surface of the substrate 20 is received under a lower surface of the substrate 20.

Figure 10A:
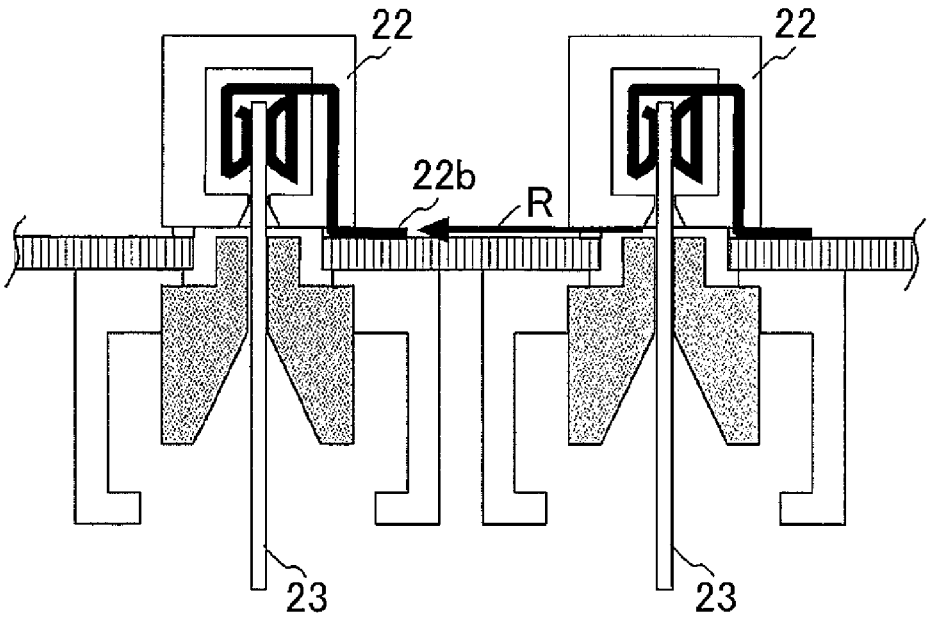
FIGS. 10A and 10B are views illustrating features of a guide device according to the modified example.
Figure 10B:
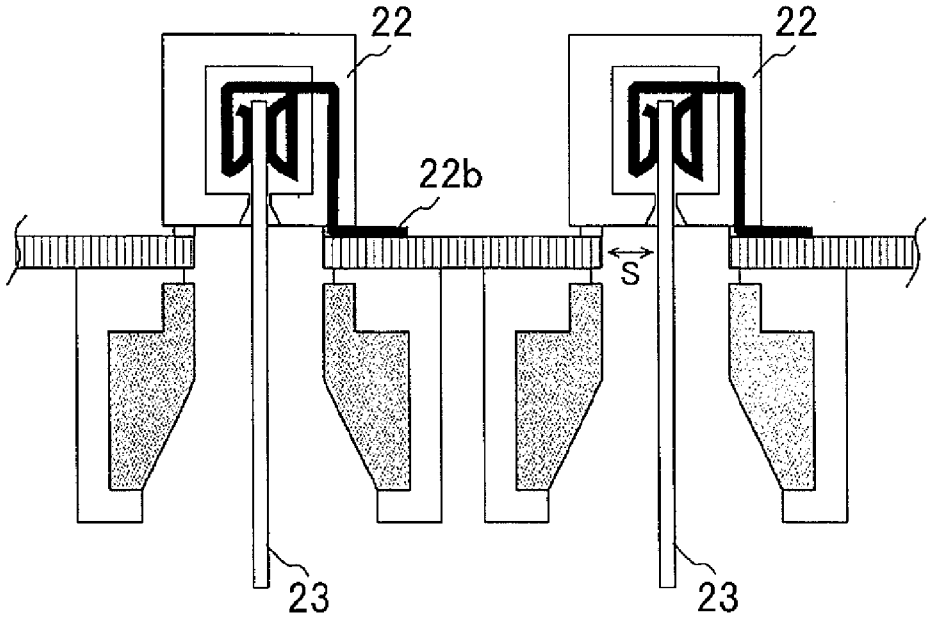
Figure 11:
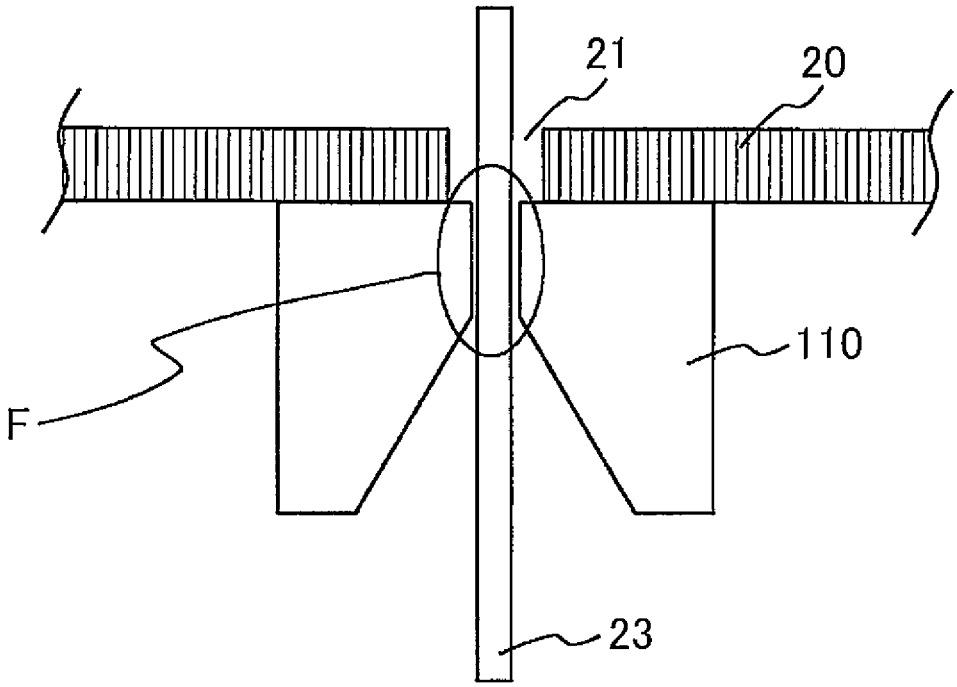
FIG. 11 RELATED ART
FIG. 11 is a view illustrating problems raised by the prior guide components.

Herein, in the case where the guide components 51*a* and 51*b* are formed to have the shape of extending to the extent that reaches the upper surface of the mounted substrate 20, if the state of the guide components 51*a* and 51*b* is maintained unchanged like the prior configurations (in other words, the guide portion 11 is maintained constantly in the closed state), as shown in FIG. 10A, a path R along the surface would be formed on the substrate surface between adjacent component terminals 23, and a problem that the insulation distance (distance along the surface) cannot be ensured would arise. It is required to ensure such an insulation distance between component terminals where a high electric potential difference is generated for driving an Insulated Gate Bipolar Transistor (IGBT), for example.

By contrast, with the guide device 50 of the modified example, after the engagement of the component terminal 23 and the substrate 20 is completed, the guide portion 11 is changed from the closed state to the open state manually or automatically (FIG. 9B). With the open state, the guide components 51*a* and 51*b* are moved to a position (separate position) away from the component terminal 23, thus avoiding a state in which the guide hole 15 used in guiding the component terminal 23 is in contact with or close to the component terminal 23. Further, the portion of each of the guide components 51*a* and 51*b* that extends up to the upper surface of the substrate 20 is received under the lower surface of the substrate 20, and the resulting space S ensures an insulation distance between the component terminals 23.

As described above, in the guide device 50 of the modified example according to the embodiment of the present invention, the guide components 51*a* and 51*b* of the guide portion 11 have the shape that extending the length d of the guide hole 15 to the extent that reaches the upper surface of the substrate 20 in the closed state. According to this shape, the guide device 50 of this modified example, as compared with the above guide device 10 provided with the opening portion 16 having the same slope, improves the positional accuracy in inserting the component terminal 23 into the guide hole 15. Further, like the above guide device 10, the guide device 50 of the modified example has a mechanism for enabling the guide portion 11 to be away from (separate from) the component terminal 23 after the component terminal 23 is guided to a specified position (the through hole 21 of the substrate 20, etc). Therefore, the component terminal 23 can be prevented from being worn due to a contact with the guide portion 11, and the insulation distance between the component terminals 23 can be ensured.

Furthermore, although in the above embodiment, an example in which the guide portion 11 is formed by two guide components 11*a* and 11*b* is shown, the guide portion 11 may also be formed by equal to or more than three guide components so long as a shape for allowing the component terminal 23 to move into the guide hole 15 can be formed.

Furthermore, in the above embodiment, the closed state and the open state of the guide components 11*a* and 11*b* are realized by the step like first wall surface 13*a* and second wall surface 13*b* formed in the outer portion 13 and the separating mechanism portion 12 which has elastic force. However, configurations for realizing the closed state and the open state of the guide components 11*a* and 11*b* are not limited to this, and various configurations may also be adopted. For example, it may be a configuration in which a slope may be provided in the wall surface of the outer portion 13 so as to enable the guide components 11*a* and 11*b* to slide obliquely, or a rotating shaft may be provided in the guide components 11*a* and 11*b* so as to enable the guide components 11*a* and 11*b* to rotate towards outside, or the guide components 11*a* and 11*b* themselves may be removed.

In addition, although in the above embodiment, a configuration in which the closed state and the open state formed by the guide components 11*a* and 11*b* are reversible is described, it may be a configuration in which once the closed state is changed into the open state, the closed state cannot be returned. Further, although in the above embodiment, it is disclosed that the separating mechanism portion 12 is a separate component (for example, a metal spring) from the guide components 11*a* and 11*b*, the structure of this component is not limited to this. For example, if the guide components 11*a* and 11*b* are formed by a synthetic resin or the like, a shape having a leaf spring mechanism may be provided to any one of the guide components 11*a* and 11*b* by an integral molding process.

The guide device according to the present invention may be utilized when a component terminal inserted into an electric circuit substrate or the like is guided to a specified position such as a through hole, and it is particularly applicable to a situation where the wearing of the component terminal generated due to contacting with a guide device is intended to be avoided.

What is claimed is:

1. A guide device that guides a component terminal, comprising: a guide portion having at least two guide components and configured to guide the component terminal to a specified position; and a separating mechanism portion configured to move the guide portion away from the component terminal after the component terminal is guided to the specified position as compared with before the guidance of the component terminal, wherein the guide portion defines a ran-through hole having a slope from one end to the other end by making the at least two guide components abut with each other, and the separating mechanism portion is configured to move the guide portion away from the component terminal by making the at least two guide components separate from each other after the guidance of the component terminal, wherein the guide device is mounted to one surface of a substrate in such a manner that a through hole formed in the substrate corresponds to the guide portion, the component terminal inserted into the guide portion from the one surface side of the substrate, passes through the through hole and is guided to a position that penetrates through another surface of the substrate, and the separating mechanism portion is configured to move the guide portion away from the component terminal after a connector terminal engages with the component terminal passing through the other surface of the substrate.

2. The guide device according to claim 1, wherein the run-through hole includes:

an opening portion formed in a conical shape or a square-tapered shape; and a guide hole extending from a vertex of the opening portion and having a shape corresponding to a shape of the component terminal.

3. The guide device according to claim 1, wherein the separating mechanism portion is configured to move the guide portion away from the component terminal according to an operation applied externally after the guidance of the component terminal.

4. A guide device that guides a component terminal, comprising: a guide portion having at least two guide components and configured to guide the component terminal to a specified position; and a separating mechanism portion configured to move the guide portion away from the component terminal after the component terminal is guided to the specified position as compared with before guidance of the component terminal, wherein the guide portion defines a run-through hole having a slope from one end to another end by making the at least two guide components abut with each other, and the separating mechanism portion is configured to move the guide portion away from the component terminal by making the at least two guide components separate, from each other after the guidance of the component terminal, wherein the guide portion is configured in such a shape that when the guide device is mounted to one surface of a substrate in such a manner that a through hole formed in the substrate corresponds to the guide portion, before the component terminal is guided to the specified position, the guide portion defines the run-through hole in the through hole so as to extend substantially to the other surface of the substrate.

5. The guide device according to claim 4, wherein the guide device is configured such that after the guidance of the component terminal, the separating mechanism portion moves the guide portion away from the component terminal so that a space for achieving insulation which corresponds to the through hole is provided between the component terminal and the substrate.

* * * * *